United States Patent [19]

Smet

[11] Patent Number: 4,887,555

[45] Date of Patent: Dec. 19, 1989

[54] ARRANGEMENT FOR CLEANING A STEAM GENERATOR WITH A WATER JET

[76] Inventor: Carlo Smet, Zwanendreef 32, 2360 Oud-Turnhout, Belgium

[21] Appl. No.: 180,977

[22] PCT Filed: Jul. 28, 1987

[86] PCT No.: PCT/BE87/00012

§ 371 Date: Mar. 25, 1988

§ 102(e) Date: Mar. 25, 1988

[30] Foreign Application Priority Data

Jul. 29, 1986 [BE] Belgium ..... 0/216991

[51] Int. Cl.[4] ..... F22B 37/54; F28F 15/00

[52] U.S. Cl. ..... 122/382; 122/392; 165/95

[58] Field of Search ..... 122/381, 382, 392; 15/316 R, 317; 165/95

[56] References Cited

U.S. PATENT DOCUMENTS

| | | | |
|---|---|---|---|
| 4,487,165 | 12/1985 | Weber et al. | 122/392 |
| 4,526,135 | 7/1985 | Calhoun et al. . | |
| 4,565,206 | 1/1986 | Booij | 122/381 X |
| 4,576,123 | 3/1986 | Lahoda et al. . | |
| 4,640,346 | 2/1987 | Weber et al. | 122/382 X |
| 4,653,435 | 3/1987 | Lebouc | 122/382 |
| 4,676,201 | 6/1987 | Lahoda et al. | 122/382 X |
| 4,715,324 | 12/1987 | Muller et al. | 122/381 |
| 4,769,085 | 9/1988 | Booij | 122/382 X |

FOREIGN PATENT DOCUMENTS

| | | |
|---|---|---|
| 889330 | 10/1981 | Belgium . |
| 889706 | 1/1982 | Belgium . |
| 890490 | 1/1982 | Belgium . |
| 900716 | 2/1985 | Belgium . |
| 0077255 | 4/1983 | European Pat. Off. . |
| 0084867 | 8/1983 | European Pat. Off. . |

*Primary Examiner*—Edward G. Favors

*Attorney, Agent, or Firm*—Cushman, Darby & Cushman

[57] ABSTRACT

The arrangement for cleaning a steam generator fitted with a bundle of pipes (9) comprises a plurality, for example three spray-lances (1–3) with spray-heads (6), which lie in a vertical plane in working position and are bent over 90° adjacent the outflow openings from the spray-heads (6). There is further provided a carriage fitted with a spray-head rotatable about the lengthwise axis thereof, which is connected to a hose for feeding pressurized water.

18 Claims, 4 Drawing Sheets

ARRANGEMENT FOR CLEANING A STEAM GENERATOR WITH A WATER JET

ARRANGEMENT FOR CLEANING A STEAM GENERATOR WITH A WATER JET

This invention has for object to provide means for cleaning with a water jet, a steam generator which is fitted with a pipe bundle and a so-called bottom plate. Such a steam generator is for example of that type which equips a nuclear power station. Cleaning and removing as sludge the iron oxide which is present on said pipes and bottom plate, requires special steps. Such cleaning then generally also occurs with the use of high-pressure lances.

The water jets being thrown with high power by such high-pressure lances, generate reaction forces which have to be absorbed because they could be the reason why the spray-lance does damage the steam generator pipes.

To absorb said reaction forces, it has already been proposed to provide in the head of the high-pressure lances at least two, but preferably a plurality of spray holes facing one another. The reaction forces are thereby absorbed in some way, but the force wherewith one sprays, that is one thus cleans, is thereby generally more than halved. Spray-lances which have such drawbacks, are notably described in Belgian Patents 889,706 and 899,330 in the name of Booy Support B.V. and Innus Industrial Nuclear Services, respectively. Such and similar high-pressure lances then also have due to the presence of a plurality of spray holes, a substantial flow-rate and pressure-head loss, which is disadvantageous for a thorough cleaning of the steam generator.

This invention has now clearly for object to provide means which make it possible to use all of the available flow rate, while said very detrimental reaction forces which move the spray-lances away from the accurate position thereof, are completely neutralized.

In a first embodiment, the invention thus relates to an arrangement for removing said iron oxides which have been deposited both on the pipes and over the bottom plate from the steam generator, and actually inside a steam generator where there is no access to the so-called water path, that is the free space which extends between two so-called hand holes, between two pipe bundles. In some cases, the cleaning does indeed have to be performed from an observation hole which does not open on the so-called water path, so that special dispositions have to be taken to let the device wherewith the rinse water is being fed, be directed between the pipes, taking also into account those reaction forces which are generated when the water being sprayed under high pressure, does hit said bottom plate and/or said pipes.

To allow performing and cleaning efficiently and without any danger of damage to the pipes proper, the arrangement according to this first embodiment is formed by at least one, but preferably a plurality of, for example three spray-lances which are received adjacent the spray-head thereof with outflow opening, in a common bearing, in such a way that they lie in operating condition, in a vertical plane and the water jet from said lances is rotatable from the vertical plane over an angle of $+85°$ and $-85°$ at the most, because each spray-lance is mounted with the one end thereof on a common rotatable component which simultaneously comprises a connector for supplying the high-pressure water, which component has inner channels wherethrough the high-pressure water flows from said connector in said spray-lances, whereby said spray-lances are rotatably connected to a positioning pin, which is rotatable about the lengthwise axis thereof and which is lockable with the head thereof between two vertical pipes.

In an advantageous embodiment, the end of said spray-lances is bent over 90° adjacent the spray-head outflow openings.

Still according to the invention, said spray-lances are made from a material which allows a torsion, which is required for rotating said rotatable component wherewith they form a single unit.

In a remarkable embodiment, said positioning pin is provided with a substantially T-shaped head which is lockable between two succeeding steam generator pipes, by rotating said positioning pin about the lengthwise axis thereof and bringing said head from the horizontal to the vertical position.

In a second embodiment, which has the same object but which is intended for cleaning with a water jet a steam generator which is fitted with a pipe bundle, which lies inside a space formed by an upstanding casing, whereby the space is further bounded by a bottom plate and said casing is provided adjacent the bottom plate generally with two, but preferably with a plurality of hand holes facing one another, which open on the water path.

In said second embodiment the arrangement comprises means for displacing from one said hand holes, a carriage fitted a spray-head which is rotatable about the lengthwise axis thereof, and said spray-head is connected to a hose for feeding pressurized water.

In a first possible embodiment, said means are comprised of at least one, but preferably a plurality of cables which are stretched between said hand holes, cables wherealong said carriage is movable.

In a variation of the embodiment, said means are comprised of a rigid guide section wherealong said carriage is movable, whereby said guide section is build-up from a plurality of extension pieces.

A feature of the arrangement according to the invention lies in said positioning element being provided with an electric cell which as the carriage is being moved relative to said pipes, generates a series signals and converts the succeeding spacings as measured between said cell and said pipes, into signals which are processed by means of an electronic circuit to determine the position of said carriage relative to two succeeding pipes and to act upon the displacement or on the stopping, respectively, of said carriage.

Other details and features of the invention will stand out from the following description, given by way of non limiative example and with reference to the accompanying drawings, in which.

Figure 1:
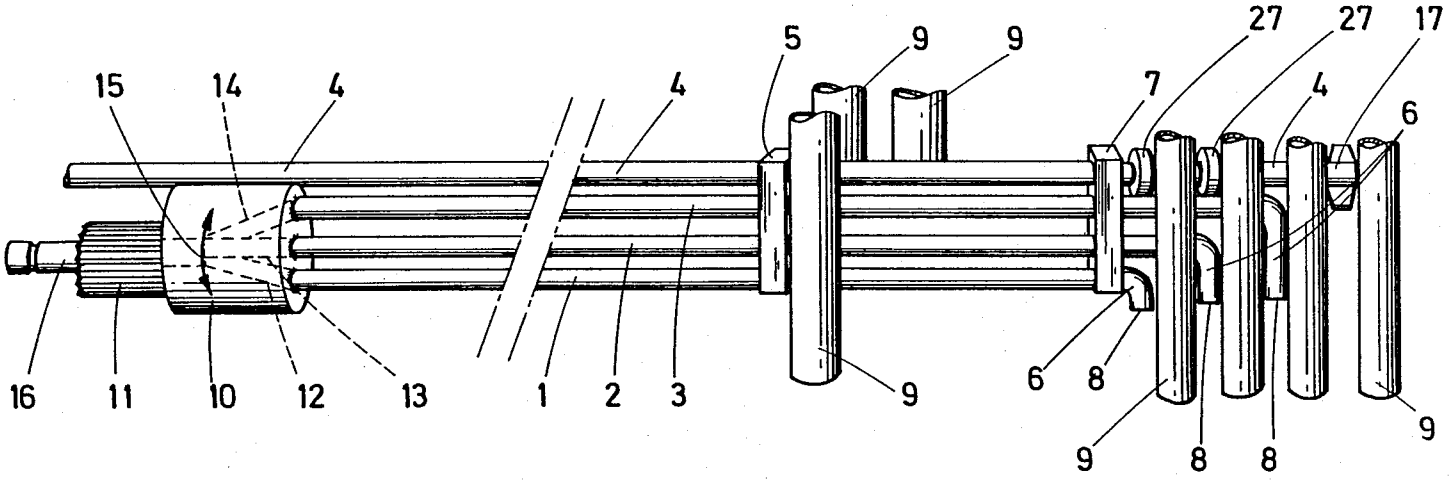
FIG. 1 is a perspective showing of the arrangement according to the invention, in a first embodiment thereof, whereby a series pipes from a steam generator are also partly shown.

The arrangement which is shown in FIG. 1, is comprised of a number spray-lances 1, 2 and 3, and a positioning pin 4.

Figure 5:
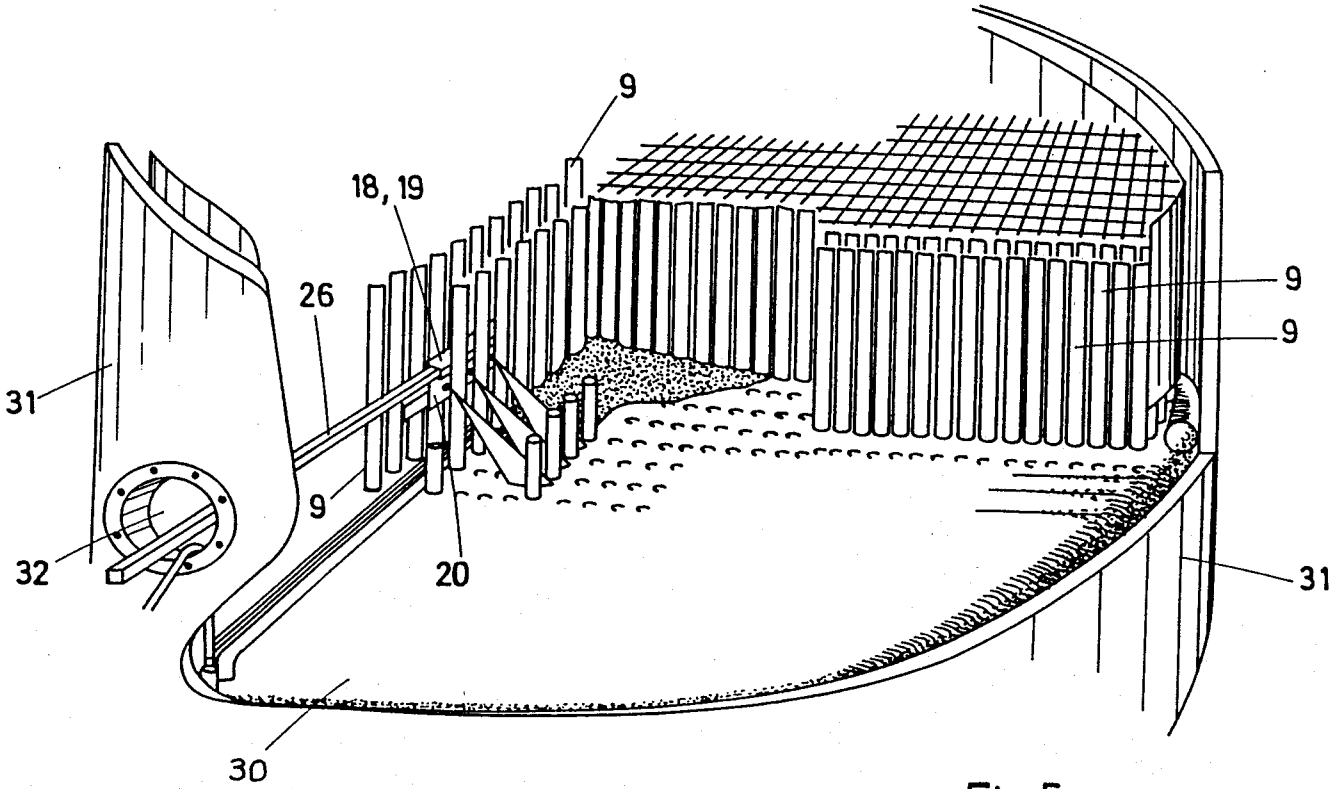
FIG. 5 shows a bundle of pipes passing through the bottom plate of a steam generator.

The three spray-lances and the positioning pin are connected on the one hand by a steel support 5. The spray-heads 6 from the spray-lances 1, 2 and 3 are bent over 90°. Adjacent said bent spray-heads, the three spray-lances and the positioning pin 4 are mounted in a support 7 which is made from nylon or a technically-equivalent material. Each said spray-heads is fitted with jet-shapers 8. The spacing between two jet-shapers is equal to the spacing between two pipes 9 from a pipe bundle which is part of a steam generator. Referring to FIG. 5, the pipes 9 form a bundle and are diagrammatically represented passing through the bottom plate 30 of the steam generator within casing 31 having an observation hole 32.

Between the supports 5 and 7, the spray-lances 1, 2, 3 and the positioning pin 4 may further be embedded in an elongated rectangular structure from nylon or a technically-equivalent material.

At that end thereof away from the spray-heads 6, the three spray-lances 1–3 open into a common rotatable component 10. Inside said component 10 the rotation of which is obtained by means of a gear wheel 11 connected thereto, three channels 12, 13 and 14 run in the extension of the spray-lances 1, 2 and 3. The three channels 12–14 merge together in a common channel 15 which projects outside gear wheel 11 in the shape of a connector 16. Said connector 16 is connected to a high-pressure hose, not shown. The rotatable component 10 is rotatable about the center line thereof and actually over about 160°. This causes rotating about the center line thereof not only of the spray-lance 2, but also of the spray-lances 1 and 3. This is made possible due to the selection of that material the spray-lances 1–3 are made of. Due to the rotating about the center-line thereof of spray-lances 1, 2, 3, said 90°-bent spray-heads may be brought from the vertical position as shown in the figure to a leftward substantially horizontal position and to a rightward substantially horizontal position, and vice-versa. This is a very remarkable feature of the arrangement according to the invention.

When spraying water under high pressure through the spray-heads 6 from the spray lances 1–3, those reaction forces which are generated by said high-pressure spraying, are neutralized due to the action of positioning pin 4. Said positioning pin 4 is indeed provided at the one end thereof with a T-shaped head 17 which ends in a pointed shape on either side of the center line of the positioning pin. The positioning pin T-shaped head is provided along both sides thereof with truncated cones the wider base of which is directed towards the positioning pin lengthwise axis.

When the spray-heads 6 of spray-lances 1, 2, 3 and the T-shaped head 17 from positioning pin 4 lie in the position as shown in FIG. 1, the complete arrangement can be moved between the pipes 9 from the steam generator. By rotating the T-shaped head 17 from a vertical to a horizontal position, the locking of the positioning pin and thus of the complete arrangement relative to the steam generator pipes 9 is obtained.

As already stated hereinabove, the reaction forces which occur when spraying water under high pressure against the steam generator bottom plate are neutralized by locking between two pipes 9, the horizontally-located T-shaped head 17 from locking pin 4.

As the spacing between two suceeding pipes from a steam generator is known, the positioning pin 4 and consequently the complete arragement can be moved over the required distance, by means of a pneumatic or hydraulic device, not shown. Due to the cone-shaped ends of the T-shaped head 17, said head will adjust in the suitable position between two pipes 9, which also means that the spray-heads 6 from the spray-lances 1, 2 and 3 will come to lie in the required position relative to the pipes 9. Those reaction forces which are generated when spraying water under high pressure vertically downwards, in the direction of the steam generator bottom plate, will be neutralized thereby as the complete arrangement is retained stationary by the positioning pin 4, mainly the T-shaped head 17 thereof, both in a vertical and a horizontal plane.

Due to the presence of the jet-shapers 8 in each one of the spray-heads 6 from the spray-lances 1 to 3, an optimum water jet may be insured for each spray-lance. Said structure makes it possible not to make use of spray holes provided sidewise in the spray-lance spray-heads to absorb the reaction forces. Due to the measures being proposed according to the invention, the complete arrangement can be firmly locked relative to steam generator pipes 9 during spraying. Those vibrations which occur when spraying water under high pressure are thereby neutralized.

The fact that the complete water flow-rate being available for each lance, can be used is of great importane for thoroughly cleaning said components. There have been described in the preamble the disadvantages of spray-heads which for neutralizing said reaction forces, are provided with a plurality of, for example two facing spray openings.

Substantially half the usable water flow-rate is lost with such spray-lances.

Locking the arrangement according to the invention may also occur by mounting cams 27 on the positioning pin 4. When rotating the positioning pin, cams 27 will lock between two succeeding pipes and also result in locking the arrangement relative to pipes 9.

According to the method of the invention, the arrangement is moved from a sight-hole provided in the steam generator casing, in the direction of the steam generator center line. The displacement from the steam generator casing to the center line thereof may occur manually or mechanically. Said components do not belong to the invention principle.

Figure 2:
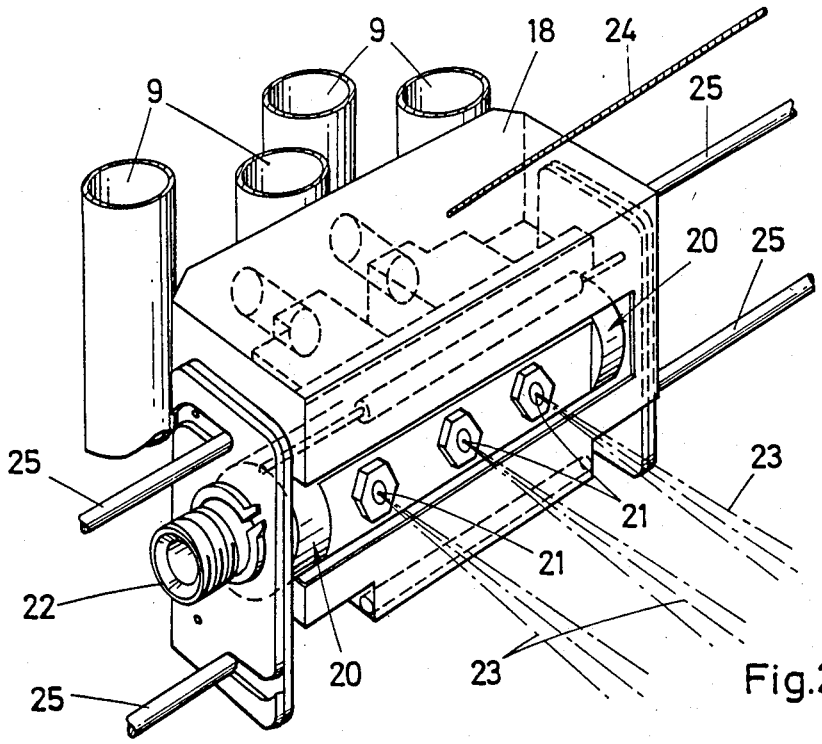
FIG. 2 is a perspective showing of a second arrangement according to the invention.
Figure 3:
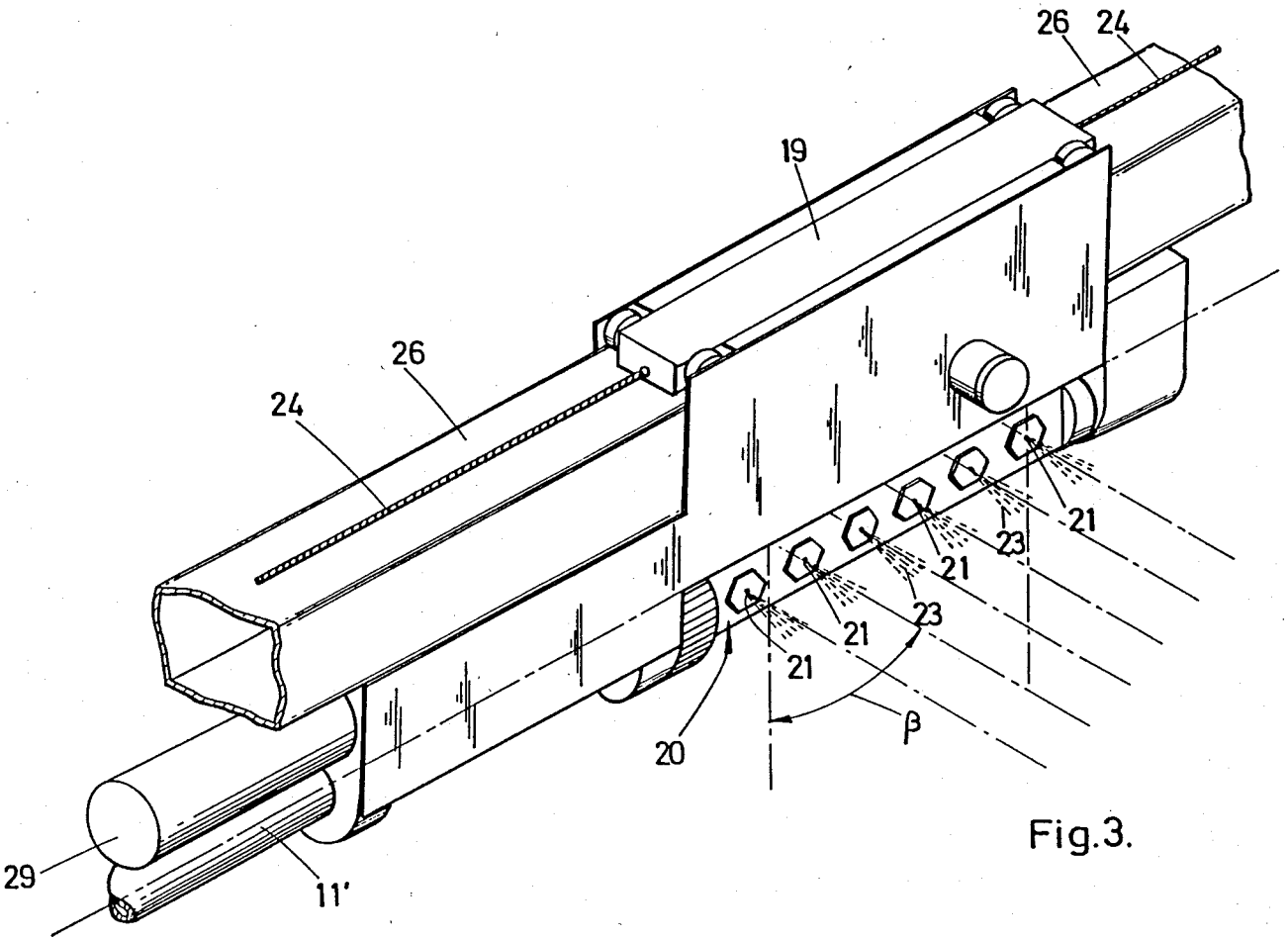
FIG. 3 shows also in perspective, a variation of the arrangement as shown in FIG. 2.

The arrangements as shown in FIGS. 2 and 3 differ from the first, just-described arrangement, by the use of a carriage 18, 19 respectively.

It is possible with a carriage 18, 19 respectively, to work in the so-called water path from the steam generator.

Both the carriage 18 (FIG. 2) and the carriage 19 (FIG. 3) are fitted with a cylinder-shaped spray-head 20, which is rotatable about the lengthwise axis thereof and is provided with a number spray nozzles 21. The cylinder-shaped spray-head 20 mounted in carriage 18, 19 respectively, connects through a mouthpiece 22 with a hose, not shown, for feeding high-pressure water. When mouthpiece 22 rotates due to rotating of the hose, not shown, which connects to the mouthpiece, or due to the action of a motor 29 mounted in carriage 19, the water jets 23 which are thrown from the spray nozzles 21 will be rotated over the required angle stepwise in a vertical plane.

Because the carriage is fitted with a sensor which measures the angle of the spray-head or the water jets, respectively, it is possible to determine with a high accuracy the impact point of the water jet on the steam generator bottom plate. This allows to so divide the spray time that every portion of the bottom plate will be sprayed for an equal time, whether said portion lies near the spray-head or nearer the steam generator casing. In such a way there is obtained a varying speed for the rotating of the spray-head. It is clear that by measuring angle $\beta$ (FIG. 3), it is possible to adapt thereto not only the rate wherewith the spray-head swings, but also the cleaning water pressure to said angle. The angle $\beta$ is measured between the vertical and the direction of water jet 23. A cleaning cycle begins as the carriage with spray-head is located in front of a pipe row with the spray nozzles directed downwards (angle $\beta=0$).

The spray-head now begins to swing with the highest swing rate as the water pressure is now low. As the angle increases, the swing rate will decrease as a function of said angle and the water pressure will increase, also as a function of said angle. This goes on until the water jets reach the bottom plate edge and the casing. The spray-head will then swing rapidly back to the vertical position and clean the other side of the steam generator.

There should be avoided as much as possible that the water jets impinge on the steam generator casing, because this might result in the iron oxides being flushed back between the pipes. This is why the largest angle whereunder spraying is performed, is dependent on the spray-head position inside the steam generator and dependent on the size of the steam generator proper.

Said angle varies continuously during cleaning of the steam generator, namely from $\pm 45°$ to $\pm 80°$, exceptionally more depending how far the spray-head lies on the casing side or in the steam generator center.

The number spray nozzles 21 on a rotatable spray-head 20 is arbitrary (2 to 10 for example), but the spacing between the center lines of two spray nozzles 21 always corresponds to the spacing between two pipes 9 from a steam generator.

Both carriage 18 and carriage 19 are connected to a hauling cable 24, in such a way that the complete arrangement can be moved several times from the casing of a steam generator to the center thereof, to perform a plurality of cleaning cycles.

In the embodiment as shown in FIG. 2, the carriage 18 moves along cables 25 which have been previously stretched between two access openings as may be found in the casing of a steam generator. Stretching the cables 25 occurs with conventional means, for example by resorting to an apparatus as used for stretching reinforcement rods in pre-stressed concrete.

The carriage 19 as shown in FIG. 3 does not differ essentially from carriage 18 as shown in FIG. 2. The basic difference with the embodiment as shown in FIG. 2 is mainly to be seen in the use of a sectional shape 26 with an arbitrary cross-section and built-up from a plurality of components. The section 26 in the present embodiment is tube-shaped, but it is clear that the cross-section wherealong the carriage 19 will be guided is not an essential feature of the invention. Carriage 19 can be moved alternately as it is connected to hauling cables 24. The cylinder-shaped spray-head 20 lies underneath carriage 19, it is also provided with spray nozzles 21 and also connects with a cylinder-shaped mouthpiece 11' to a hose not shown in the figure, for supplying water under high pressure.

Bringing the section 26 in the water path can occur by making use of a specific device therefor which is in no case part of the invention and which will not be described hereinafter.

The section 26 is movable from the steam generator casing to the center line thereof and it is thereby also not necessary to move said section 26 past the steam generator center line. The cleaning cycle of the steam generator can occur with the help of the same means from an opposite access opening. The stability of the arrangement according to this variation is naturally very great, because those reaction forces which are generated when spraying under high pressure, are completely neutralized. Cancelling such reaction forces is due to said tube-shaped section 26 absorbing completely such reaction forces.

In some cases, it is possible to work with more than one spray-head. When working with two or more spray-heads to perform simultaneously the cleaning, this means that two spray-heads spray at the same time, under the same angle (for example in FIG. 3), but in opposite direction in such a way that they both clean the same side of the bottom plate and pipes from the steam generator, while both spray-heads facing one another perform the same movement in one and the same time interval.

By controlling stepwise and automatically the displacement of the carriage(s), it is possible when resorting to very reliable technical means, to move the carriage(s) over a distance which corresponds to the center-to-center spacing of two adjacent pipes 9.

Such means are comprised of a so-called positioning unit which comprises an electric cell which sends during the displacement of the carriage relative to said pipes, a series signals in the direction of said pipes 9, and converts the successively measured distances into signals which are processed with an electronic circuit or microcomputer to determine the position of said spray-head relative to a following pipe row and to act upon the movement of said carriage.

Figure 4:
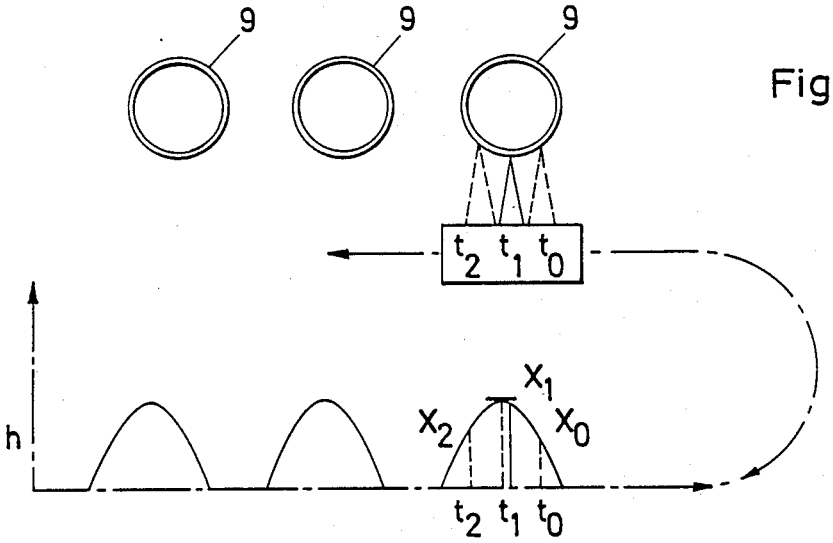
FIG. 4 is a diagrammatic showing which shows the working of the positioning unit from an arrangement as shown in FIGS. 2 or 3.

In the diagrammatic showing of FIG. 4, the strength of the signals is shown along the Y-axis, while the distances are shown along the X-axis. The cell thus moves together with the carriage 18, 19 respectively, in parallel relationship with a row of pipes 9 lying in a vertical plane. Depending on whether the spacing between the electric cell and the wall of the first pipe encountered in a row becomes smaller or larger, the signal becomes larger or smaller, respectively.

The electric cell lies at a determined distance in position to (FIG. 4) and a signal Xo is being generated. Some time thereafter, the electric cell lies in t1 and a signal X1 is generated. As signal X1 is larger than signal Xo, the spacing between the electric cell and the wall of the pertaining pipe becomes smaller. Still later, the electric cell lies in position t2 and signal X2 is generated. X2 is smaller than X1 because the spacing between the electric cell and the pipe wall becomes larger.

Between t1 and t2, the cell has generated a maximum signal which corresponds to the minimum spacing of the cell relative to the pertaining pipe. It is now only necessary to position the electric cell depending on said maximum signal, with the use of an electronic circuit, and consequently to locate the spray nozzles 21 accurately between two succeeding pipes.

It appears very clearly from the above-described arrangements, that it is possible to clean very accurately both the bottom plate and the pipes connecting thereto of a steam generator, and actually from the outer wall in the direction of the steam generator center line. This is due to the problem of the stepwise and accurate positioning both of the spray-lances and of the carriages with spray-heads relative to a series pipes still to be cleaned, having been solved with the above-described means.

Removing the water sprayed on the bottom plate or reaching same, occurs along the circumference, along the inner wall of the steam generator casing.

It is clear that the invention is not limited to the above-described embodiment and that many changes might be brought thereto without departing from the scope of the invention.

I claim:

1. Arrangement for cleaning with a water jet, a steam generator fitted with a bundle of pipes (9) which lie inside a space formed by an upstanding casing, whereby said space is further bounded by a bottom plate and said casing has adjacent said bottom plate, a plurality of observation holes wherethrough at least one spray-lance (1–3) may be let in and further slipped in the space between the pipes (9) proper, to remove by means of said water jet the iron oxide deposited on said pipes (9) and over said bottom plate, characterized in that it is formed by at least one, but preferably a plurality of, for example three spray-lances (1–3) which are received adjacent the spray-head (6) thereof with outflow opening, in a common bearing (7), in such a way that they lie in operating condition, in a vertical plane and the water jet from said lances (1–3) is rotatable from the vertical plane over an angle of +85° and −85° at the most, because each spray-lance (1–3) is mounted with the one end thereof on a common rotatable component (10) which simultaneously comprises a connector (16) for supplying the high-pressure water, which component (10) has inner channels (12–14) wherethrough the high-pressure water flows from said connector (16) in said spray-lances (1–3), whereby said spray-lances (1–3) are rotatably connected to a positioning pin (4), which is rotatable about the lengthwise axis thereof and which is lockable with the head (17) thereof between two vertical pipes.

2. Arrangement according to claim 1, characterized in that the end of said spray-lances (1–3) is bent over 90° adjacent the outflow openings from said spray-heads (6).

3. Arrangement according to claim 2, characterized in that said outflow openings are provided with jet-shapers (8).

4. Arrangement according to claim 2, characterized in that said spray-lances (1–3) are made from a material which allows a torsion as required for rotating said rotatable component (10) wherewith they form a single unit.

5. Arrangement according to claim 1, characterized in that said positioning pin (4) goes through said bearing (7) said spray-lances (1–3) go through.

6. Arrangement according to claim 5, characterized in that said positioning pin (4) is fitted with a substantially T-shaped head (17) which is lockable between two succeeding pipes (9) by rotating said positioning pin (4) about the lengthwise axis thereof and bringing said head (17) from the vertical to the horizontal position.

7. Arrangement according to claim 6, characterized in that said T-shaped head (17) is provided with two cone-shaped elements the wider bases of which face the center line of the positioning pin (4).

8. Arrangement according to claim 2, characterized in that that spray-lance to be considered as uppermost in working position, is provided with at least one cam (27) which will lock between two succeeding pipes (9) when rotating the lance.

9. Arrangement according to claim 1, characterized in that at least said spray-lances (1–3) are embedded inside an elongated plastic block, with a width which is somewhat smaller than the spacing between two pipes (9).

10. Arrangement for cleaning with a water jet, a steam generator fitted with a bundle of pipes (9) which lie inside a space formed by an upstanding casing, whereby the space is further bounded by a bottom plate and said casing has adjacent the bottom plate, at least two, but preferably a plurality of hand holes facing one another, which open on the water path, characterized in that it comprises mean to displace from one said hand holes, a carrige (18;19) fitted with a spray-head (20) rotatable about the lengthwise axis thereof, and said spray-head (20) is connected to a hose for feeding pressurized water.

11. Arrangement according to claim 10, characterized in that said means are comprised of at least one, but preferably a plurality of cables (25) which are stretched between said hand holes and wherealong said carriage (18) is movable.

12. Arrangement according to claim 10, characterized in that said means are comprised of a rigid guide section (26) wherealong said carriage (19) is movable.

13. Arrangement according to claim 12, characterized in that said rigid guide section (26) is built-up from a plurality of extension pieces.

14. Arrangement according to claim 10, characterized in that said spray-head (20) is fitted with a plurality of spray nozzles (21) and the spacing between two succeeding spray nozzles (21) corresponds to the spacing between two succeeding pipes (9).

15. Arrangement according to claim 10, characterized in that said carriage (18;19) is removably mounted relative to said cables (25) or section (26), respectively.

16. Arrangement according to claim 10, characterized in that said carriage (18;19) is connected to an alternately-movable hauling cable (24).

17. Arrangement according to claim 10, characterized in that said carriage (18;19) is provided with an electronic positioning unit which determines the position of said carriage (18;19) relative to the pipes to be cleaned (9).

18. Arrangement according to claim 17, characterized in that said positioning unit is fitted with an electric cell which generates a series signals during the displacement of the carriage (18;19) relative to said pipes and converts the succeeding spacings as measured between said cell and said pipes (9), into signals which are processed by means of an electronic circuit, to determine the position of said carriage (18;19) relative to two succeeding pipes (9) and to act upon the displacement or the stopping, respectively, of said carriage (18:19).

* * * * *